US007607852B2

(12) United States Patent
Washington

(10) Patent No.: US 7,607,852 B2
(45) Date of Patent: Oct. 27, 2009

(54) LIQUIDS APPLICATOR

(76) Inventor: Pamela D. Washington, 1492 Arrow Wind Ter., Charleston, SC (US) 29414

( * ) Notice: Subject to any disclaimer, the term of this patent is extended or adjusted under 35 U.S.C. 154(b) by 665 days.

(21) Appl. No.: 11/366,759

(22) Filed: Mar. 2, 2006

(65) Prior Publication Data

US 2007/0206988 A1 Sep. 6, 2007

(51) Int. Cl.
*A46B 11/04* (2006.01)

(52) U.S. Cl. ..... 401/272; 401/176; 401/179

(58) Field of Classification Search ..... 401/176, 401/179, 182, 272
See application file for complete search history.

(56) References Cited

U.S. PATENT DOCUMENTS

| | | | | |
|---|---|---|---|---|
| 2,547,287 | A | | 4/1951 | Sanders et al. |
| 2,956,298 | A | * | 10/1960 | Jagtenberg ..... 401/176 |
| 3,417,762 | A | * | 12/1968 | Hall ..... 401/176 |
| 3,655,290 | A | | 4/1972 | Griffith |
| 3,739,789 | A | | 6/1973 | Cataneo et al. |
| 4,063,829 | A | | 12/1977 | La Mura |
| 4,408,920 | A | * | 10/1983 | Walther et al. ..... 401/176 |
| 4,447,169 | A | | 5/1984 | Vartoughian |
| 4,594,014 | A | | 6/1986 | Korper |
| 4,625,741 | A | | 12/1986 | Gardiner |
| 4,640,637 | A | | 2/1987 | Winthrop |
| 4,691,720 | A | | 9/1987 | Schmitz |
| 4,726,386 | A | | 2/1988 | Schultz |
| 4,768,529 | A | | 9/1988 | Mahruki |
| 4,838,722 | A | | 6/1989 | Katz |
| 4,927,282 | A | | 5/1990 | Morane et al. |
| 4,946,302 | A | | 8/1990 | Uchida |
| 4,955,745 | A | | 9/1990 | Vauquelin |
| 5,035,525 | A | | 7/1991 | Konose |
| 5,092,702 | A | | 3/1992 | Kurokawa |
| 5,123,766 | A | | 6/1992 | Babiak |
| 5,152,305 | A | | 10/1992 | Niv |
| 5,397,195 | A | | 3/1995 | Goncalves |
| 5,716,104 | A | | 2/1998 | Keating et al. |
| 5,735,623 | A | | 4/1998 | Gueret |
| 6,174,099 | B1 | | 1/2001 | Patel et al. |
| 6,176,632 | B1 | | 1/2001 | Kageyama et al. |
| 6,209,548 | B1 | | 4/2001 | Harrison et al. |
| 6,217,935 | B1 | | 4/2001 | Hubbell |
| 6,328,040 | B1 | | 12/2001 | Stein |
| 6,474,891 | B1 | | 11/2002 | Liu |
| 6,530,709 | B1 | | 3/2003 | Washington |
| 6,533,482 | B1 | | 3/2003 | Byun |

(Continued)

*Primary Examiner*—David J Walczak
(74) *Attorney, Agent, or Firm*—Harleston Law Firm LLC

(57) ABSTRACT

An all-in-one liquids applicator includes: (a) an elongated, hollow cartridge housing 11; (b) a cartridge assembly 12 disposable within the cartridge housing 11, the cartridge assembly comprising at least one liquids cartridge 13 and an interior slide 35, the liquids cartridge comprising an open upper end and an opposite, lower end of the liquids cartridge comprising a cartridge liquids aperture 45, at least a portion of the interior slide 35 being slidable into the cartridge 13 from the open upper end of the cartridge 13; (c) an exterior slide 16 that is slidable over the cartridge housing 11; (d) an applicator head portion 15 that is removably attachable to an open lower end of the cartridge housing 11; and (e) a liquid dispensing mechanism 49 that causes liquid to be dispensed from the cartridge liquids aperture 45 into the applicator head portion in response to movement of the exterior slide 16 over the cartridge housing 11.

22 Claims, 9 Drawing Sheets

U.S. PATENT DOCUMENTS 6,554,520 B2 4/2003 Tsuchiya
6,641,320 B1 11/2003 Ballot et al.
6,685,375 B1 * 2/2004 Crocker ..... 401/176
6,688,796 B1 2/2004 Liu
6,837,640 B2 1/2005 Kobayashi
6,854,914 B2 2/2005 Keating et al.
6,857,807 B2 2/2005 Akaishi
6,905,277 B2 6/2005 Saito et al.
2002/0087164 A1 7/2002 Speitling
2002/0164193 A1 11/2002 Brown
2003/0031501 A1 2/2003 Eadie
2003/0152411 A1 8/2003 Prokopos
2004/0005185 A1 1/2004 Endo
2004/0042841 A1 3/2004 Noguchi
2004/0071493 A1 4/2004 Hendrix-Stavropoulos
2004/0194796 A1 10/2004 Burghaus
2004/0195377 A1 10/2004 Williams et al.
2005/0025558 A1 2/2005 Severa
2005/0031405 A1 2/2005 Carneiro et al.
2005/0063766 A1 3/2005 Chen et al.
2005/0063768 A1 3/2005 Tani
2005/0100390 A1 5/2005 Jantz
2005/0105956 A1 5/2005 Gutberlet et al.
2005/0158114 A1 7/2005 Noguchi
2005/0169695 A1 8/2005 Noguchi
2005/0184101 A1 8/2005 Masuda
2005/0211261 A1 9/2005 Capristo

* cited by examiner

LIQUIDS APPLICATOR

BACKGROUND OF THE INVENTION

1. Technical Field

The present invention is an all-in-one applicator for applying liquid to a substrate, more particularly, for dispensing increments of nail polish, hair relaxant, paint, glue, or other liquids, including gels, onto a brush at the base of the applicator for direct, controlled application onto a fingernail, hair, canvas, paper, fabric, dry wall, or any other suitable substrate.

2. Background Information

Generally, nail polish is supplied in small bottles and applied with a brush that is attached to the bottle's screw-on cap. Oftentimes, one or more of the ingredients in nail polish which has not been used for awhile settle out of solution, so the user must invert or shake the bottle prior to use. To apply nail polish, the user removes the cap, dips the brush back into the polish, and wipes one side of the brush along the side of the neck of the nail polish bottle. When additional polish is needed, the user dips the brush back into the bottle of polish, wipes off one side of the brush, and again applies the polish on the brush to their nails. Application of nail polish in this manner requires the use of two hands and repeated trips to the bottle of nail polish. When applying polish to the user's own fingernails, this requires using the hand with recently applied polish, and risking contact with the bottle or nearby objects that may smear the recently applied polish. When this happens, the nail polish on the smeared nail must be removed and reapplied. For professional nail technicians, repeat trips to the bottle of polish and wiping off one side of the brush takes time and increases the cost of doing business and therefore the prices charged to the customer.

Also, small nail polish bottles are easily tipped over and brushes are frequently dropped on the way to or from the bottle. Young girls are fond of painting their nails and frequently end up accidentally spilling hard-to-clean nail polish on furniture, clothing, bedspreads, carpet, etc.

Currently, liquid nail polish is formulated to dry quickly upon application to enable the wearer to resume normal activities as soon as possible. The additional time required for repeated trips to the bottle of polish unfortunately allows the nail polish in the open bottle to dry out. Polish which has been open too long or is old tends to thicken, making future applications more difficult. In addition, nail polish coated along the neck of the bottle, and on the top of brush bristles when they remain above the level of polish in the bottle, tends to harden during storage. This dried polish interferes with future applications of polish and with closure of the bottle when a polishing job is finished. Sometimes it is necessary to dispose of a bottle of nail polish which is only partially empty because the remaining polish is too thick or the bottle is too difficult to reopen.

Applicators for distributing hair relaxant and other chemical formulas onto human hair are similarly limited. Most lay people find it difficult to apply hair relaxant neatly and evenly to their curly hair. Two hands are required for conventional application. The hair relaxant tends to glob on the hair and drip onto the user's clothing, the table, and the floor. Although they are usually more experienced, hairdressers often have similar problems times multiple customers. Chemical relaxant is damaging to the skin and allergies can develop with repeated exposure of the hands and face to it. Hair relaxant can also stain or otherwise damage clothing and other substrates. If the relaxant is not applied in the prescribed manner, results can be unsatisfactory and the hair can be damaged. Hairdressers and lay people alike can profit greatly from an efficient applicator.

BRIEF SUMMARY OF THE INVENTION

The present invention is an all-in-one applicator for applying liquids, such as nail polish, hair relaxant, hair color, dental preparations, white-out, paint, or glue. The liquids applicator includes: (a) an elongated, hollow cartridge housing; (b) a cartridge assembly disposable within the cartridge housing, the cartridge assembly comprising at least one liquids cartridge and an interior slide, the liquids cartridge comprising an open upper end and an opposite, lower end of the liquids cartridge comprising a cartridge liquids aperture, at least a portion of the interior slide being slidable into the cartridge from the open upper end of the cartridge; (c) an exterior slide that is slidable over the cartridge housing; (d) an applicator head portion that is removably attachable to an open lower end of the cartridge housing; and (e) a liquid dispensing mechanism that causes liquid to be dispensed from the cartridge liquids aperture into the applicator head portion in response to movement of the exterior slide over the cartridge housing. The applicator head portion preferably comprises an applicator brush. The liquid is dispensed from the cartridge liquids aperture onto the brush.

The applicator of the present invention permits a user to apply drops of polish or another liquid on an applicator brush from a cartridge containing polish that is not exposed to air. The liquid applicator of the present invention avoids wasting nail polish or other liquid, is more efficient, and saves time and money. The applicator of the present invention eliminates the need for repeated trips to the bottle of nail polish or other liquid and the need to wipe off one side of the applicator brush between uses. The present applicator is particularly useful for applying gels to the surface of a user's fingernails. For example, the present applicator is ideal for providing a nail biter with a full set of nail acrylics.

The applicator of the present invention also allows a user or beautician to apply hair relaxant and other such formulas neatly and efficiently. In addition to cosmetic and beauty preparations, the present applicator can be used for applying paints, including enamels, lacquer, artist's paints, or house paints. The present applicator can also be used for applying glue to a substrate. The applicator of the present invention may be used for applying dental preparations to teeth. The present liquids applicator may be disposable or not. Parts, such as the cartridge, of the present applicator may be replaceable.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
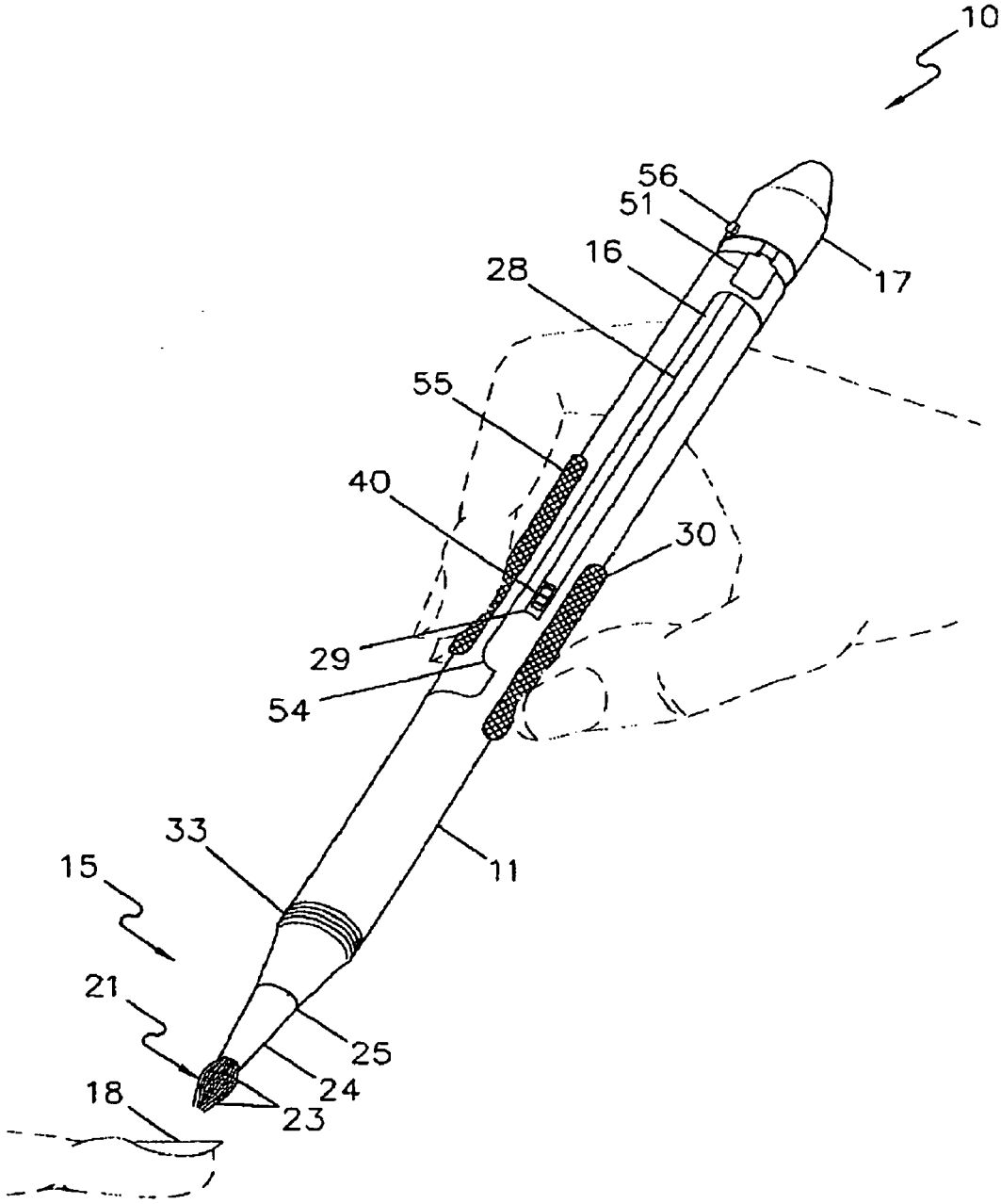
FIG. 1 is a front perspective view of a liquids applicator according to the present invention, shown in use dispensing nail polish.

In the following description, like reference characters designate like or corresponding parts throughout the several views. Also, in the following description, it is to be understood that such terms as "upper," "lower," "within," and the like are words of convenience and are not to be construed as limiting terms. Referring in more detail to the drawings, the invention will now be described.

Turning first to FIG. 1, a liquid applicator, designated generally as 10, for controlled, precise application of a liquid on a substrate is particularly useful for applying liquid nail polish to a fingernail substrate 18. The liquids applicator 10 comprises:

(a) an elongated, hollow cartridge housing 11;

(b) a cartridge assembly 12 disposable within the cartridge housing 11, the cartridge assembly comprising a liquids cartridge 13 and an interior slide 35, at least a portion of the interior slide 35 being slidable into an open, upper end of the liquid cartridge 13, an opposite, lower end of the liquids cartridge comprising a cartridge liquids aperture 45;

(c) an exterior slide 16 that fits closely over the cartridge housing 11; and (d) a liquid dispensing mechanism 49 that causes liquid to be dispensed from the cartridge liquids aperture 45 in response to movement of the exterior slide 16 over the cartridge housing 11. The applicator preferably includes an applicator head portion 15 that is removably attachable to an open lower end of the cartridge housing 11. The applicator head portion 15 preferably includes an applicator brush 21. The liquid is dispensed from the cartridge liquids aperture 45 onto the brush.

As shown in FIG. 1, an all-in-one applicator 10 generally in the form of a fountain pen can be used to apply nail polish to the surface of a fingernail. A user holds the applicator 10 in one hand while applying polish to the fingernails of the other hand, or the applicator 10 can be held by one person, such as a manicurist, who is applying polish to the fingernails of a second person. The liquids applicator 10 is preferably for use in applying nail polish or other liquids, such as acrylics, paint, glue, or hair treatment preparations. The word "liquid" is meant to include any gel with a low enough viscosity to travel through the channels/bores of the applicator 10. The applicator 10 can be held with one hand for an entire nail painting sequence.

Figure 2:
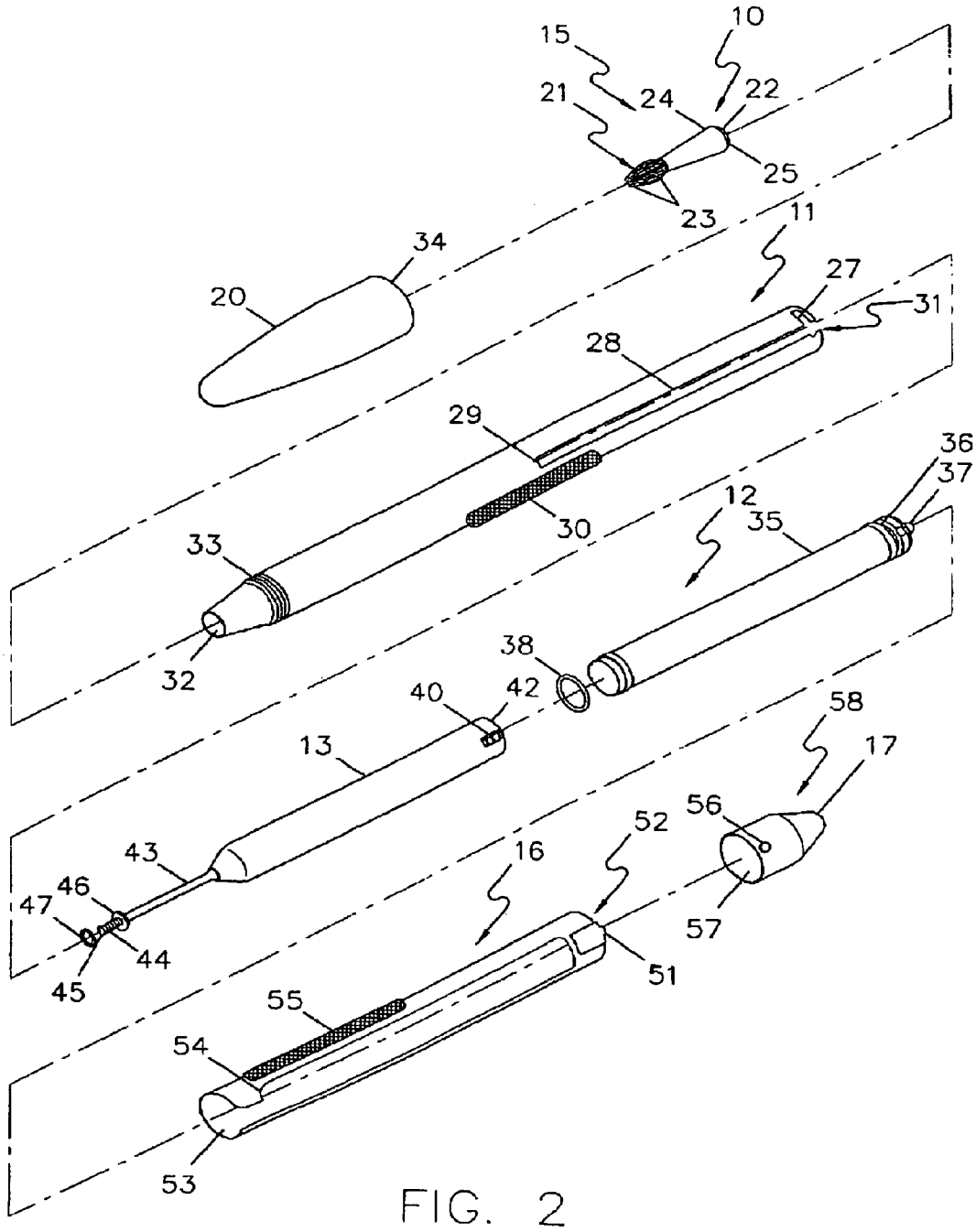
FIG. 2 is a perspective view of the parts of the liquids applicator of FIG. 1.
Figure 3:
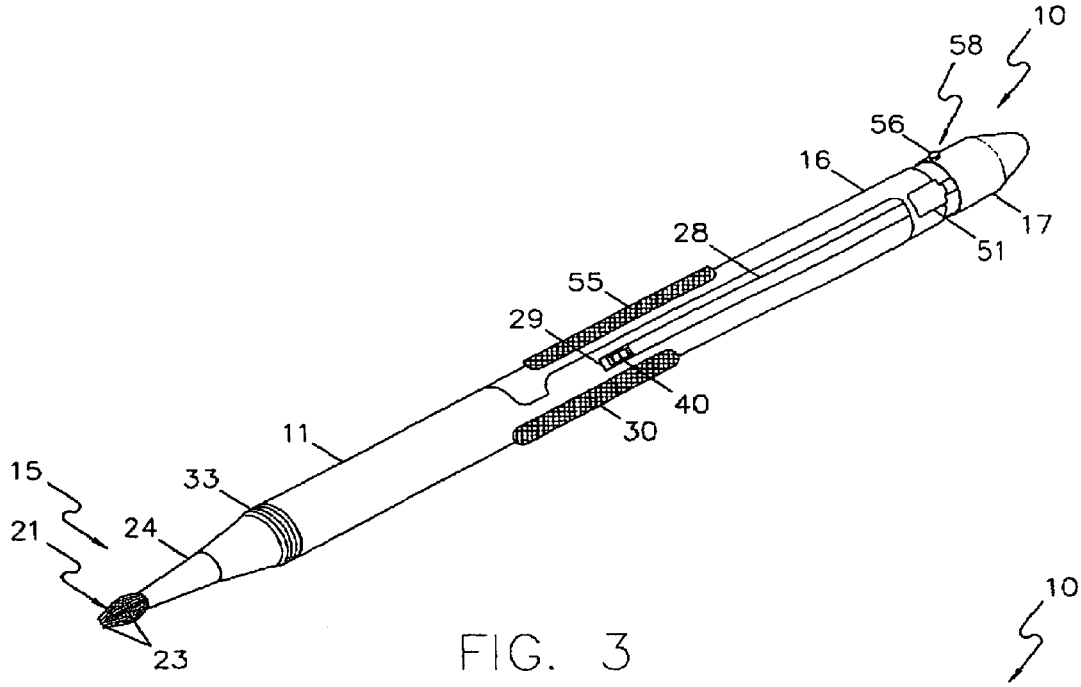
FIG. 3 is a front perspective view of a liquids applicator according to the present invention, shown in a full position.
Figure 4:
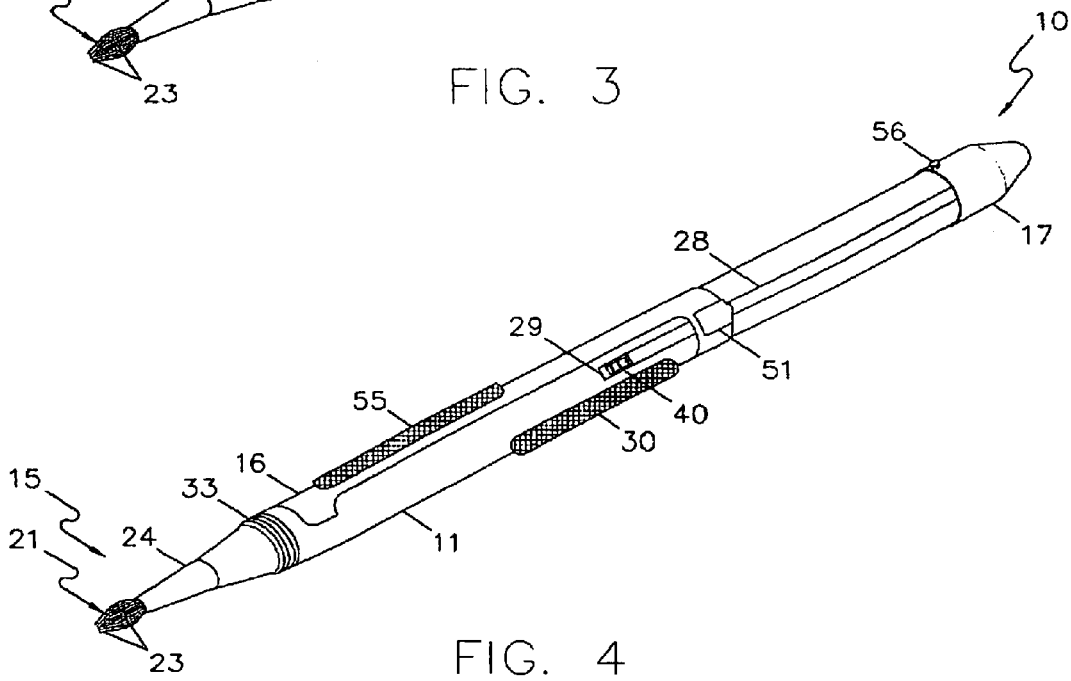
FIG. 4 is a front perspective view of a liquids applicator according to the present invention, shown in an empty position.
Figure 5:
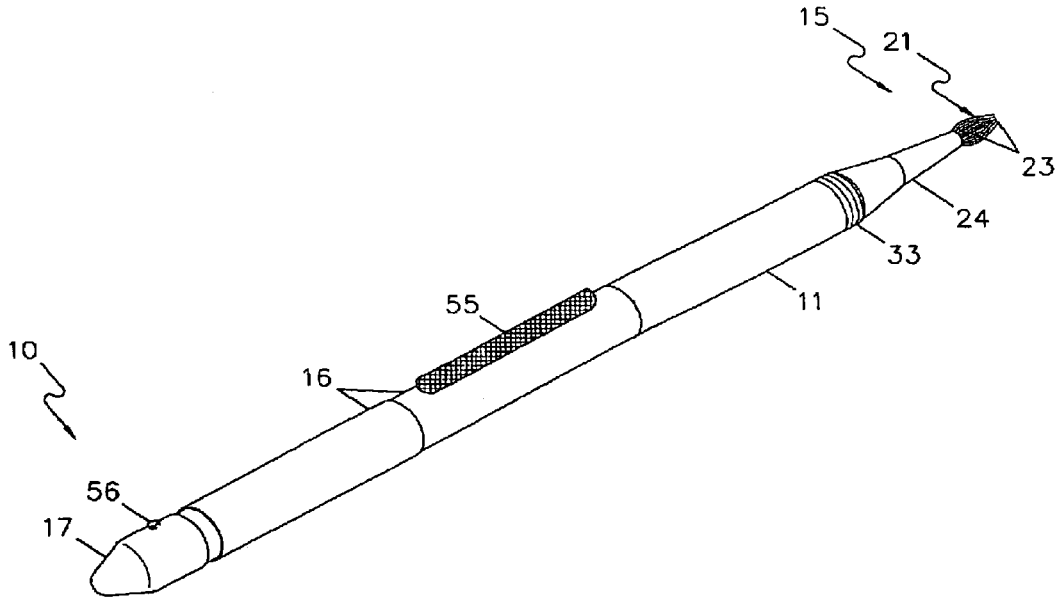
FIG. 5 is a rear perspective view of the liquids applicator of FIG. 3.

Referring to FIGS. 1-3, the cartridge assembly 12 comprises at least one, most preferably only one, liquids cartridge 13. The cartridge 13 is preferably removable, substantially cylindrical, and has a hollow central chamber 14 for holding the liquid to be applied, such as a nail polish or nail polish remover (see FIG. 8). The liquid cartridge 13 is disposable within the cartridge housing 11, preferably substantially entirely within the cartridge housing. The cartridge 13 may be refilled or disposed of and replaced when it is empty.

The relatively narrow cartridges 13 hold a different nail polish color, or polish remover. A preferred embodiment permits a user to exchange one cartridge (e.g., pale pink polish) for another (e.g., bright red polish) if a different nail polish color is desired, even if the red polish cartridge is not yet empty. The red polish cartridge may be re-inserted at a later time. The cartridge 13 and the cartridge housing are preferably made of a transparent material so that the liquid color and the amount of liquid remaining in the cartridge are apparent to the user. The cartridge may include exterior gradations so that the user can approximate the amount of liquid remaining in the cartridge. Alternatively, the cartridge 13 may be transparent and the cartridge housing 11 may include a transparent window for the user to see the color and amount of product.

The liquids cartridge 13 has a first, upper end portion that is closer to the upper end of the applicator 10 when it is being used as shown in FIG. 1, and an opposite, second, lower end portion, which is the end closer to the fingernail substrate 18 shown in FIG. 1. As seen in FIG. 2, the cartridge 13 tapers to a narrow cartridge neck 43 at the second, lower end portion of the cartridge 13. The cartridge neck 43 is preferably about one third of the length of the cartridge, as seen in FIG. 2. The lower end of the cartridge neck 43 is threaded. A narrow cartridge bore extends within the cartridge neck 43 and opens to a cartridge liquids aperture 45 at the end of the cartridge neck 43. The cartridge bore channels the liquid from inside the cartridge 13 to the small cartridge liquids aperture 45. The narrowness of the cartridge bore and the cartridge liquids aperture help to control dispersal of the nail polish or other liquid so that it is dispensed from the applicator at an optimal rate. A cartridge ring 46 around the cartridge threading 44, and a cartridge seal 47 at the lower end of the cartridge help to prevent the liquid from leaking (see FIGS. 2 and 8).

The cartridge assembly 12 further comprises an interior slide 35, which is slidable partway into the first, upper end opening 42 of the liquid cartridge 13. The interior slide 35 is preferably substantially cylindrical in shape. The first end opening 42 of the cartridge 13 has an inside diameter large enough to closely accommodate the second, lower end portion of the interior slide 35. As the liquid empties from the cartridge 13, the interior slide 35 slides farther into the cartridge 13. The cartridge 13 preferably substantially fully accommodates the interior slide 35 when the cartridge 13 is relatively empty. The interior slide slides down into the cartridge rather than screwing into it. At the upper end of the cartridge 13 is a cartridge button, or projection 40, on the outside of the cartridge near its edge. An interior slide seal 38 fits over the lower end of the interior slide 35 to help prevent leakage between the interior slide 35 and the cartridge 13.

Although one is preferred, the applicator may alternatively include two (or three) liquids cartridges 13 side by side in the cartridge housing, each having its own interior slide 35. Each cartridge may hold a different color or type of nail polish or other liquid. A user could then, for example, paint her or his nails with two different nail polish colors without having to put down the applicator. The applicator is preferably not intended to be a mixing device for mixing several liquids together. Preferably, cartridges that are pre-filled with the desired liquid are purchased and used to replace an empty cartridge in the applicator.

As seen in FIGS. 1 through 5, the cartridge housing 11 comprises a narrow cartridge housing slot 28 extending longitudinally along the upper half of the cartridge housing. The cartridge housing 11 is open at its first, upper end. At its first, upper end, the cartridge housing slot 28 is open to the first, upper cartridge housing opening 31. At the opposite, lower end of the cartridge housing slot 28 is a cartridge stop 29. The cartridge housing 11 further includes a cartridge housing finger grip 30 on an outer surface of the cartridge housing, preferably about midway along the cartridge housing adjacent the cartridge housing finger grip 30. At its first, upper end, the cartridge housing slot 28 opens to a notch 27 in the cartridge housing. The short cartridge housing notch 27 is generally perpendicular to the cartridge housing slot 28. The cartridge assembly is inserted into the cartridge housing 11. As seen in FIGS. 1 and 3, the cartridge housing slot 28 is just wide enough to slidably accommodate the cartridge projection 40 on the cartridge 13.

At the opposite, lower end of the substantially cylindrical-shaped cartridge housing 11 is an opposite, lower, brush opening 32 for accommodating the applicator head portion 15 of the liquids applicator 10. The applicator head portion 15 is preferably removable so that it can be separately cleaned, or replaced. The brush does not recess into the cartridge housing. As shown in the preferred applicator of FIGS. 1 through 5, the applicator head portion 15 includes a brush support 24 at its open upper end, and a brush 21 at a lower end of the applicator head portion. The interior of the cartridge housing adjacent the brush opening 32 is preferably threaded to correspond to the brush head threading 25 adjacent the brush support opening 22 at the end of the brush support 24. The applicator head portion 15 can be removed as desired by unscrewing it from the end of the cartridge housing 11.

Figure 8:
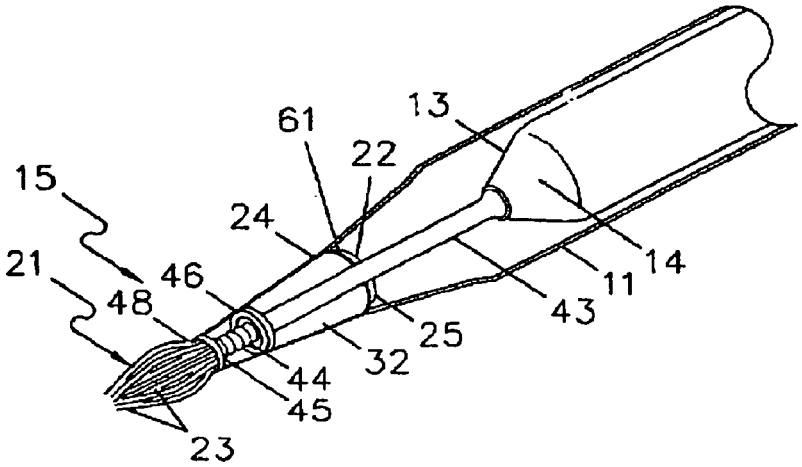
FIG. 8 is a side view of an end portion of a liquids applicator according to the present invention.

Continuing with FIGS. 1-5, the applicator brush 21 is made up of bristles 23, which are preferably animal hairs of a suitable texture (e.g., sable and badger). Other types of bristles, such as plastic, may be employed. As shown in FIG. 8, a first bristle end 48 of each bristle 23 is mounted in the end of the brush support 24, and an opposite, second bristle end is a free end. As shown in FIG. 8, the brush support 24 has a central bore 61, which opens to the bristles. When the cartridge 13 is in place in the cartridge housing 11, the cartridge neck 43 extends through the cartridge housing brush opening 32 and through the bore 61 in the brush support 24. The end of the brush support bore 61 (inside) preferably includes threads that correspond to the cartridge threads 44 at the (outside) end of the cartridge neck 43, so the cartridge can be screwed into the brush support 24. Liquid from the cartridge liquids aperture 45 thus flows through the cartridge neck 43 and through the cartridge liquids aperture 45 to the ends of the brush bristles 23.

As shown in FIG. 2, an optional, removable brush cap 20 is removably attachable over the applicator head portion 15 on the lower end of the applicator. An open end 34 of the brush cap 20 includes threading on the inside lip (not shown) that corresponds to threads 33 on the lower end of the cartridge housing 11. The threading holds the brush cap 20 in place on the applicator when the applicator is not in use. Alternatively, the inside lip of the brush cap may include a groove that corresponds to a bead on the lower end portion of the cartridge housing (where the threading is shown in FIG. 2), so that the brush cap can be snapped onto the cartridge housing. The brush cap 20 keeps the brush 21 pliable during storage.

When the applicator 10 is in use, the brush cap 20 may be secured over the end cap 17 so that the brush cap is out of the way yet less likely to be lost. The end cap 17 may include threads or a bead that corresponds to threads or a groove, respectively, on the inside lip of the brush cap 20 for this purpose.

As shown in FIGS. 1 through 5, the exterior slide 16 fits closely over the cartridge housing 11. The exterior slide 16, which is capable of sliding up and down the cartridge housing 11, includes an exterior slide finger grip 55 on its outer surface. Ideally, the user places a forefinger on the exterior slide finger grip 55, and a thumb on the cartridge housing finger grip 30 as she or he holds the applicator like a pen, as shown in FIG. 1. The exterior slide 16 is open ended and is substantially cylindrical in shape, except that it includes a cut-out portion 54 that accommodates the finger grip 30 on the cartridge housing 11 and the cartridge housing slot 28. The finger grips 30, 55 are preferably abraded or coated with an agent to prevent slippage.

Figure 6:
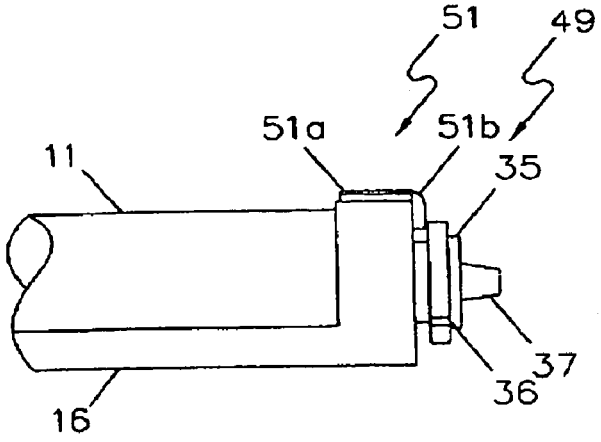
FIG. 6 is a side elevational view of a portion of a liquids applicator according to the present invention.

The liquids applicator 10 preferably further includes a dispensing mechanism 49 for dispensing liquid from the liquids cartridge 13, as seen in FIG. 6. This dispensing mechanism 49 also locks the cartridge 13 in the liquids applicator 10 when the applicator is in use. The dispensing mechanism 49 allows replacement of the liquids cartridge 13 when it is empty or when a change in liquid is desired. (This dispensing/locking mechanism 49 is useful for locking in the cartridge even where the entire applicator is disposable.) As seen in FIGS. 1 though 6, the dispensing/locking mechanism 49 includes an exterior slide nib 51 at the upper end of the exterior slide 16. The exterior slide nib 51 is preferably shaped like an upside down "L", as illustrated in FIG. 6. A first, attached portion 51*a* of the exterior slide nib 51 (one leg of the "L") is affixed to the edge of the exterior slide 16 as seen in FIGS. 2 and 6, and the other, bent portion 51*b* of the L-shaped nib 51 projects into the exterior slide upper opening 52 when the exterior slide is not on the applicator (see FIG. 6). When the exterior slide 16 is in place over the cartridge housing 11 and the interior slide 35 and cartridge 13 are in place in the cartridge housing, the second, bent portion 51*b* of the exterior slide nib 51 projects into a circular-shaped interior slide groove 36 that encircles the upper end portion of the interior slide 35. The upper end portion of the interior slide 35, which includes a central interior slide tip 37, protrudes slightly through the open end 52 of the exterior slide 16, as shown in FIG. 6. The top of the interior slide may alternatively be substantially flat (i.e., without a tip).

Figure 7:
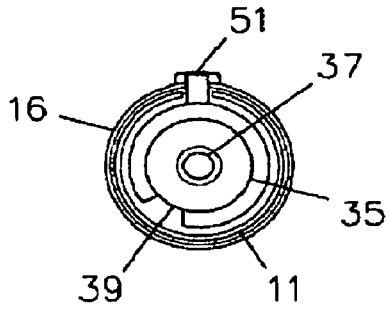
FIG. 7 is an end elevational view of the portion of the liquids applicator of FIG. 6.

The interior slide groove 36 includes a nick 39 in the interior slide groove 36, as can be seen in FIG. 7. To activate the applicator dispensing/locking mechanism 49, the exterior slide nib 51 is initially placed into the interior slide groove nick 39 once the exterior slide 16 is in place over the cartridge housing 11, and the cartridge assembly 12 is in place in the cartridge housing 11. The exterior slide 16 is then manually rotated a short distance until the exterior slide nib 51 is within the interior slide groove 36.

When the end cap screw 56 is inserted into the cartridge housing notch 27 and turned, the applicator 10 will not come apart and the cartridge 13 will not fall out, even if the applicator is turned upside down. The applicator can be laid down on a table or carried in a purse or pocket, for example, without danger of leakage.

To unlock the applicator dispensing/locking mechanism 49, the exterior slide 16 is manually rotated a short distance until the exterior slide nib 51 is within the interior slide groove nick 39. The exterior slide 16 can then be removed (by sliding it off the end of the cartridge housing), as can the interior slide 35 and then the liquids cartridge 13 (by upending the cartridge housing, for example).

Once the liquids cartridge 13 has been replaced or refilled and inserted in the cartridge housing 13, the interior slide 35 is placed into the cartridge housing 11. The exterior slide 16 is then placed over the cartridge housing 11, with the exterior slide nib 51 in the interior slide groove nick 39. The exterior slide 16 is rotated slightly to put the exterior slide nib 51 into the interior slide groove 36, as seen in FIG. 7.

When the applicator 10 is in use, the second, bent portion 51*b* of the exterior slide nib 51 moves up and down in the cartridge housing slot 28 as the interior slide 35 moves up and down in the cartridge housing 11. Since the first portion 5*la* of the exterior slide nib 51 is attached to the exterior slide 16, the exterior slide nib 51 moves up and down in the cartridge housing slot 28 as the exterior slide 16 moves up and down over the cartridge housing 11.

The second, bent portion 51*b* of the exterior slide nib 51 has approximately the same width as the cartridge projection 40. The cartridge housing slot 28 is only slightly wider than the cartridge projection 40 and the bent portion 51*b* of the exterior slide nib 51. The cartridge projection 40 lies against the cartridge stop 29, thus holding the cartridge 13 in place within the cartridge housing 11 and preventing it from wobbling. When the user pushes the exterior slide 16 down incrementally, ordinarily by means of a forefinger on the exterior slide finger grip 55 (see FIG. 1), the exterior slide nib 51 moves down. Since a portion of the exterior slide nib 51 lies within the interior slide groove 36 (see FIG. 6), the interior slide 35 is pushed down within the cartridge 13 at the same time. Pushing the interior slide 35 down within the cartridge 13 (see FIG. 2) causes the liquid within the cartridge to be expelled from the cartridge liquids aperture 45. Since the cartridge liquids aperture 45 lies against the brush 21, the expelled liquid flows onto the brush bristles 23, and can be applied on the desired substrate (see FIG. 1).

This allows for controlled, steady, precise application of the liquid from the cartridge onto the desired substrate. When the user is finished with the application, she or he pulls up slightly on the exterior slide finger grip 55 to decrease the likelihood that a drop of liquid will spill out of the applicator. The less common left handed user can use his or her thumb rather than the forefinger to move the exterior slide, or purchase a left handed applicator.

Another locking mechanism 58 is provided by the end cap 17, which includes an end cap screw 56 near the opening 57 of the end cap (see FIGS. 2 and 3). The end cap screw 56 extends through one side of the end cap at the edge of the end cap 17 adjacent the end cap opening 57. The end portion of the end cap screw 56 extends into the hollow interior of the end cap 17. When the end cap 17 is placed down over the cartridge housing opening 31 of the assembled applicator, the end portion of the end cap screw 56 is moved generally vertically into the top of the cartridge housing notch 27. The end cap 17 is then twisted in a generally horizontal direction to move the end cap screw 56 into the notch 27 on the cartridge housing 11. This temporarily locks the end cap 17 on the applicator 10 (see FIG. 3). Even when the applicator 10 is upended, the parts and liquid will not fall or seep out of the applicator. The end cap 17 can be unlocked by reversing direction, so the end cap screw 56 comes out of the cartridge housing notch 27, and then out of the cartridge housing slot 28. The applicator 10 is used to dispense and apply a liquid on a substrate, and to store the liquid when the applicator 10 is not in use.

Referring to FIGS. 9 through 14, a liquids applicator 10*b* for more viscous liquids is particularly useful for applying hair relaxant to human hair. In general, hair relaxant formulas are more viscous than nail polish, for example, and more hair relaxant is needed for a head of hair than for a set of fingernails. This hair relaxant applicator 10*b* has a greater diameter than the nail polish applicator 10 described hereinabove in order to accommodate the increased amount of viscous hair relaxant required for application on a single head of hair. Hair relaxant can also harm the scalp, face, eyes, and hands, particularly where the subject or user has cuts or abrasions on his or her skin. The relaxant-type applicator 10*b* helps the hairdresser or other user control the flow of hair relaxant so the hair relaxant or other chemical in the cartridge is less likely to contact the hairdresser's or client's skin, and therefore unlikely to cause allergic or other adverse reactions.

Figure 13:
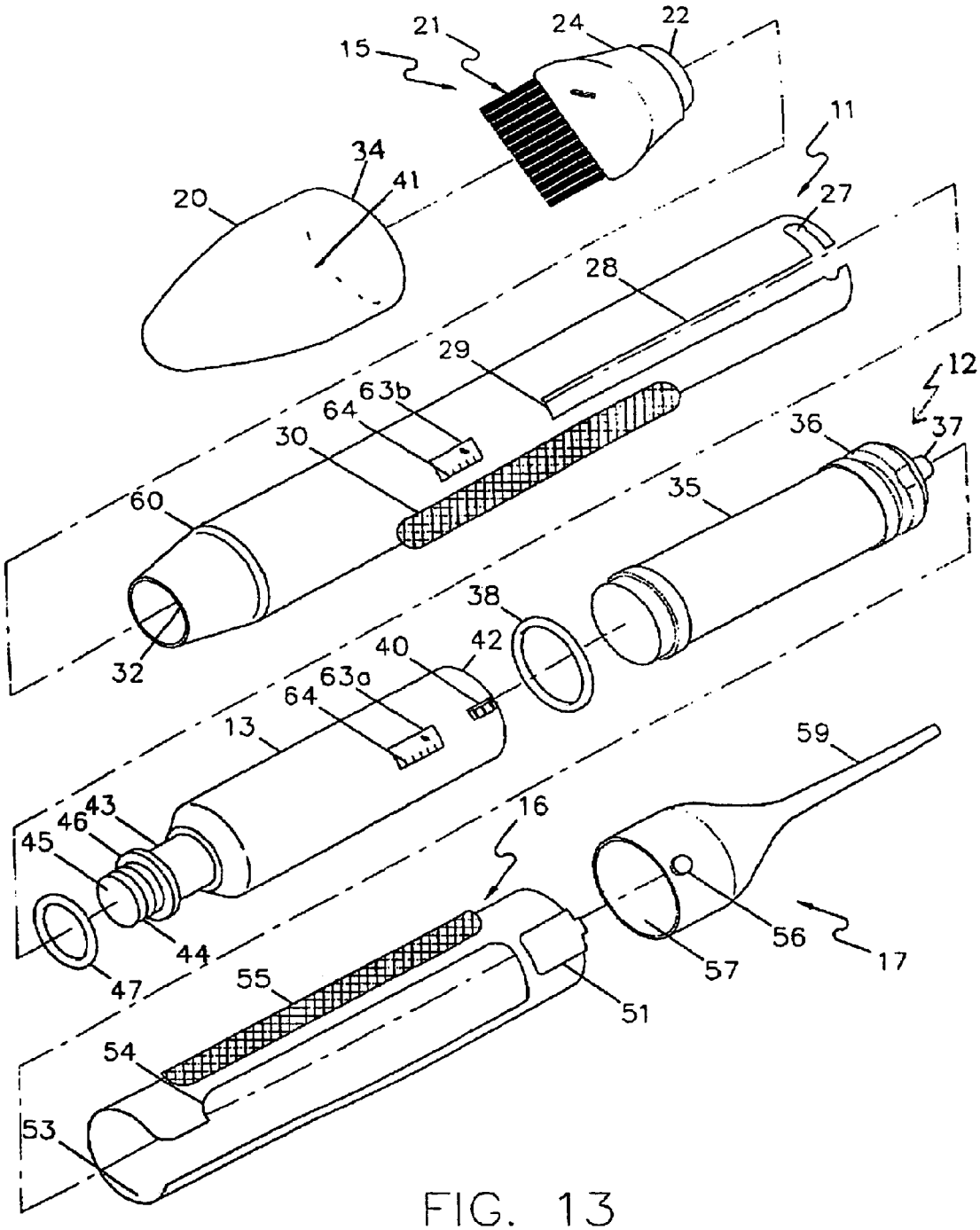
FIG. 13 is a perspective view of a liquids applicator according to the present invention.
Figure 14:
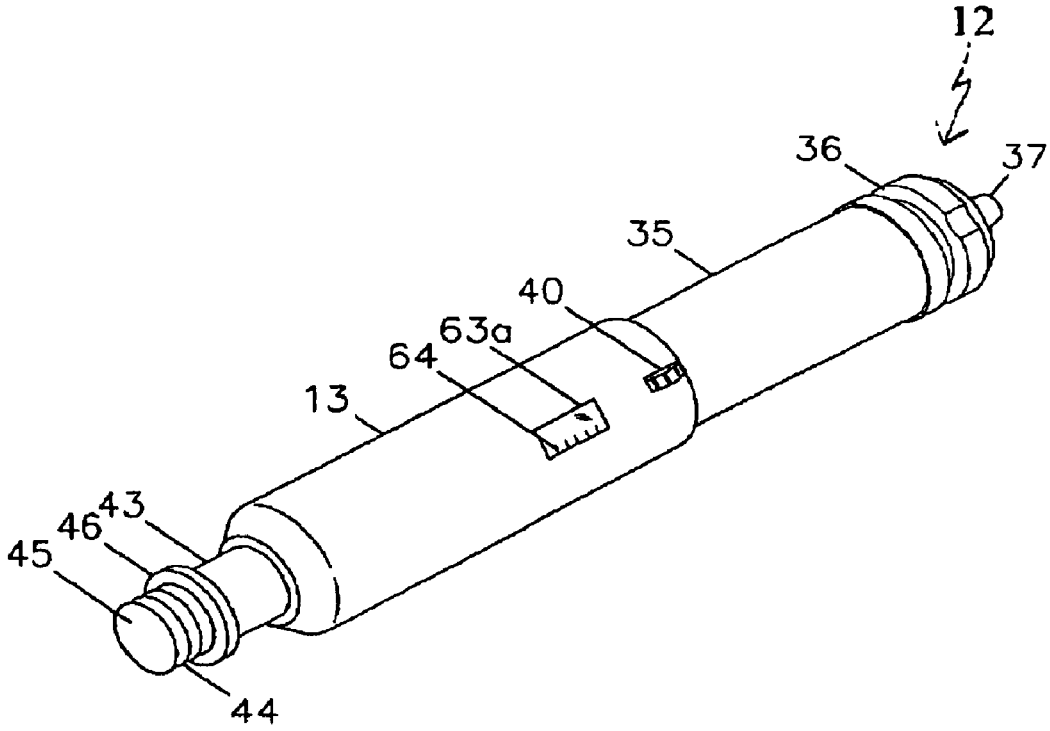
FIG. 14 is a perspective view of a cartridge assembly of a liquids applicator according to the present invention.

Referring to FIGS. 9, 10, 13, and 14, the cartridge assembly 12 comprises at least one, and preferably only one, liquids cartridge 13. The cartridge 13 is as described above. As seen in FIGS. 13 and 14, the cartridge 13 tapers to a cartridge neck 43 at the second, lower end portion of the cartridge 13. The diameter of the cartridge neck is substantially smaller than the diameter of the rest of the cartridge. The cartridge neck 43 is preferably about one fourth to one third the length of the cartridge 13, as illustrated in FIGS. 13 and 14. The lower end of the cartridge neck 43 is preferably threaded. The cartridge bore within the cartridge neck 43 opens to the cartridge liquids aperture 45 at the end of the cartridge neck 43. The cartridge bore channels the liquid from inside the cartridge 13 to the cartridge liquids aperture 45. The width of the cartridge bore and the cartridge liquids aperture help to control dispersal of the viscous liquid, so that it is dispensed from the applicator at an optimal rate. A cartridge ring 46 around the cartridge threading 44, and a cartridge seal 47 at the lower end of the cartridge help to prevent the liquid from leaking (see FIG. 13).

The cartridge assembly 12 further comprises an interior slide 35, which is slidable partway into the first, upper end opening 42 of the liquid cartridge 13, as shown in FIG. 14. The interior slide 35 is preferably substantially cylindrical in shape. The first end opening 42 of the cartridge 13 has an inside diameter large enough to closely accommodate the second, lower end portion of the interior slide 35. As the liquid empties from the cartridge 13, the interior slide 35 slides farther into the cartridge 13. The cartridge 13 preferably substantially fully accommodates the interior slide 35 when the cartridge 13 is relatively empty. At the upper end of the cartridge 13, the small cartridge projection 40 projects from the outside of the cartridge. An interior slide seal 38 fits over the lower end of the interior slide 35 to help prevent leakage between the interior slide 35 and the cartridge 13.

Although one is preferred, the applicator 10*b* may alternatively include two (or three) liquids cartridges 13 side by side in the cartridge housing, each having its own interior slide 35. Preferably, cartridges that are pre-filled with the desired liquid preparation are purchased and used to replace an empty cartridge in the applicator.

As seen in FIG. 13, the cartridge housing 11 comprises a narrow cartridge housing slot 28 extending longitudinally along the upper half of the cartridge housing. At its first, upper end, the cartridge housing slot 28 is open to the first, upper cartridge housing opening 31. At the opposite, lower end of the cartridge housing slot 28 is a cartridge stop 29. The cartridge housing 11 further includes a cartridge housing finger grip 30 on an outer surface of the cartridge housing, preferably about midway along the cartridge housing adjacent the cartridge housing finger grip 30. At its first, upper end, the cartridge housing slot 28 opens to a notch 27 in the cartridge housing. The short cartridge housing notch 27 is generally perpendicular to the cartridge housing slot 28. The cartridge assembly is inserted into the cartridge housing 11. As seen in FIG. 13, the cartridge housing slot 28 is just wide enough to accommodate the cartridge projection 40 on the cartridge 13.

As seen in FIGS. 9, 10, 13, and 14, the cartridge 13 and cartridge housing 11 optionally each include a transparent view window 63*a, b*, so the user can visually check the amount of product in the cartridge. The cartridge 13 is positioned in the cartridge housing so that the cartridge housing view window 63*b* is on top of the cartridge view window 63*a*. Either view window 63*a, b* optionally includes markings, or gradations 64, so that the user can more easily approximate the amount of liquid remaining in the cartridge 13. Alternatively, the cartridge 13 may be transparent while the cartridge housing 11 includes a view window 63*b* for the same purpose. The cartridge 13 and the cartridge housing 11, or just the cartridge housing, of the applicator 10 depicted in FIGS. 1-8 may also include this view window 63 for viewing the amount and color of polish in the cartridge.

Figure 12:
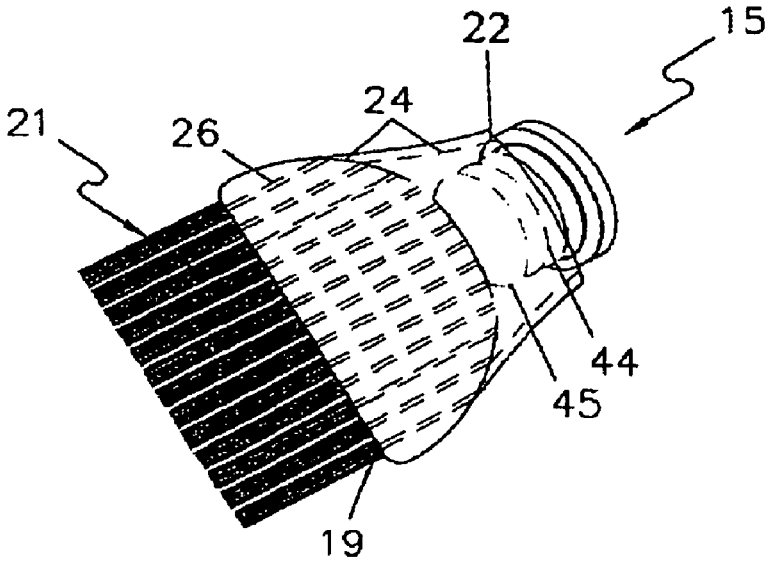
FIG. 12 is a plan view of an applicator head portion of the liquids applicator of FIG. 10.

At the opposite, lower end of the substantially cylindrical-shaped cartridge housing 11 is the opposite, lower, brush opening 32 for accommodating an applicator head portion 15 of the liquids applicator 10*b*. As shown in FIG. 12, the preferred applicator head portion 15 includes a brush support 24 at its open upper end, and a brush 21 at a lower end of the applicator head portion. The interior of the brush support 24 adjacent the brush support opening 22 is preferably threaded to correspond to the cartridge threads 44 on the end of the cartridge neck (see FIG. 12). The applicator head portion 15 can be removed as desired by unscrewing it. The applicator head portion 15 is preferably removable so that it can be separately cleaned or replaced.

Figure 11:
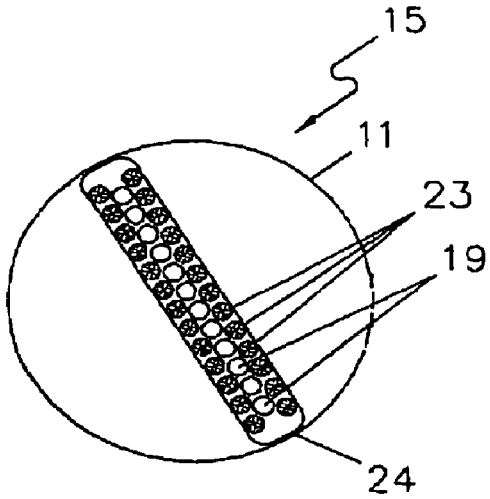
FIG. 11 is a perspective view of the parts of the liquids applicator of FIG. 9.

The brush 21 is made up of a number of bristles 23, which are preferably made of a flexible plastic material. A first bristle end 48 of each bristle 23 is mounted in the end of the brush support 24, and an opposite, second bristle end is a free end. As seen in FIG. 11, the lower end of the brush support 24 comprises a number of brush head holes 19. The brush head holes 19 open to the ends of a number of brush head channels 26 within the brush support 24, as seen in FIG. 12. The other ends of the channels 26 open to the cartridge liquids aperture 45. The channels are preferably made into the interior wall or walls of the brush support 24. When the cartridge 13 is in place in the cartridge housing 11, the cartridge liquids aperture 45 is adjacent the channels. Liquid from the cartridge liquids aperture 45 flows through the channels 26 out of the brush head holes 19 to the ends of the brush bristles 23. The bristles 23 are clustered into a plurality of bristle clusters, as seen in FIG. 11. The bristle clusters are arranged in a line adjacent the brush head holes in the end of the brush support 24.

As shown in FIG. 13, an optional, removable brush cap 20 may be snapped on or otherwise attached over the applicator head portion 15 onto the lower end of the applicator. An open end 34 of the brush cap 20 includes a groove in the inside lip (not shown) that snaps over a correspondingly sized bead 60 on the lower end of the cartridge housing 11. The cartridge housing bead 60 holds the brush cap 20 in place on the applicator when the applicator is not in use. Alternatively, the inside lip of the brush cap may be threaded to correspond to threading on the lower end portion of the cartridge housing (where the bead is shown in FIG. 13). The brush cap 20 keeps the brush 21 pliable during storage.

When the applicator 10*b* is in use, the brush cap 20 may be secured over the end cap 17 so that the brush cap is out of the way yet less likely to be lost. The end cap 17 may include threads or a bead that corresponds to threads or a groove, respectively, on the inside lip of the brush cap 20 for this purpose.

Figure 9:
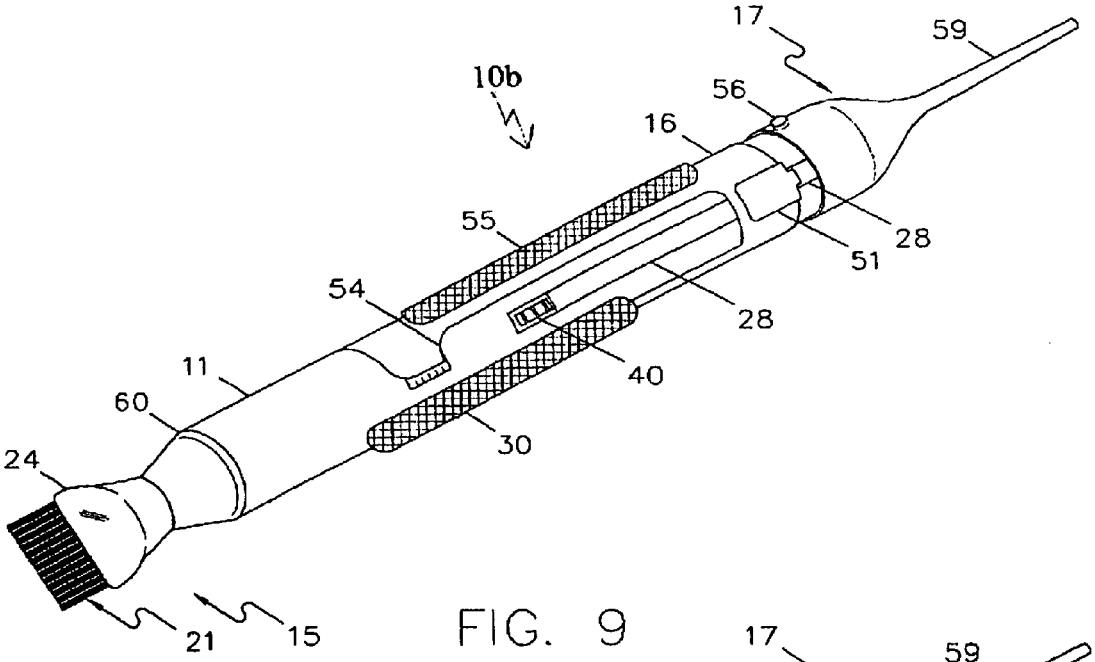
FIG. 9 is a perspective view of a hair relaxant liquids applicator according to the present invention, shown in a full position ready for use.
Figure 10:
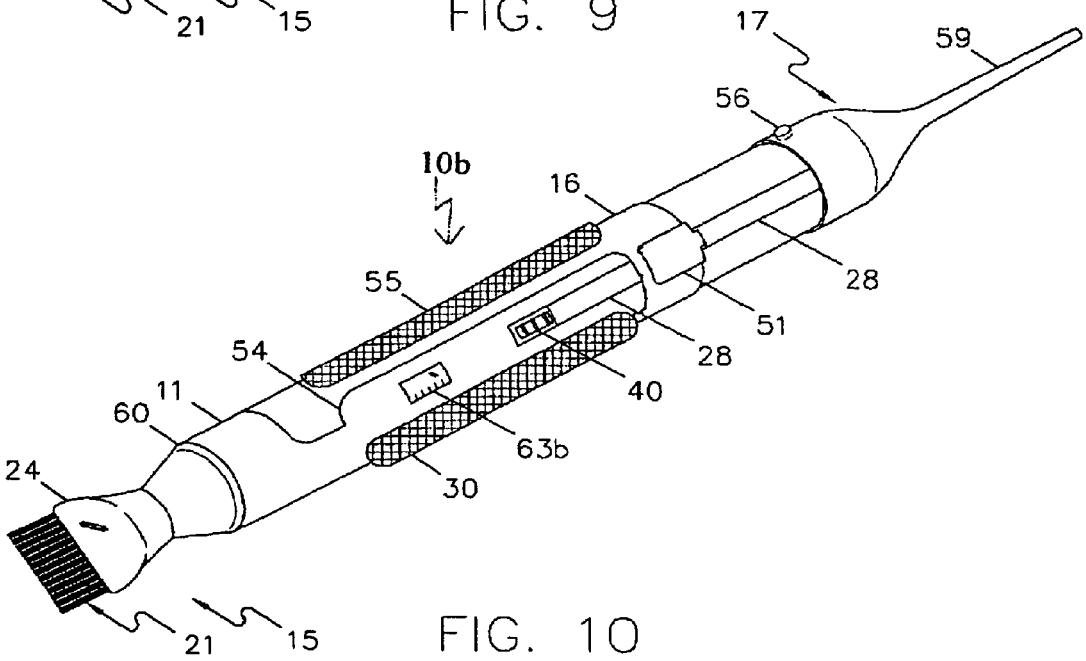
FIG. 10 is a front perspective view of the liquids applicator of FIG. 9, shown in an empty position.

Although new subjects apply hair relaxant over the entire hair shaft, repeat users are normally applying the thick hair relaxant mainly to the new growth. As shown in FIGS. 9, 10, and 13, the end cap 17 preferably includes a pick-like cap tail 59 at the end of the cap opposite the end cap opening 57. The cap tail 59 is useful for parting the hair just prior to applying the hair relaxant in that area.

The brush caps 20 herein may alternatively hold a foam or other absorbent interior layer 41 that has been soaked in acetone or any other chemical that is suitable for cleaning the particular liquid off the brush. Acetone is particularly effective for cleaning nail polish off natural brush bristles. When the brush cap 20 is snapped, screwed, or otherwise placed over the brush 21 in the manner described herein, the acetone or other chemical will clean the brush during storage or transport. The applicator brush should not be stored indefinitely in the chemical, though. If the chemical is volatile, the brush cap can be refilled, or replaced with a fresh brush cap 20. An acetone-filled brush cap 20 is also the perfect size for a user to insert a finger into it in order to clean nail polish, acrylic, etc. from the finger or fingernail.

As shown in FIG. 13, the exterior slide 16 fits closely over the cartridge housing 11. The exterior slide 16, which is capable of sliding up and down the cartridge housing 11, includes an exterior slide finger grip 55 on its outer surface. Ideally, the user places a forefinger on the exterior slide finger grip 55, and a thumb on the cartridge housing finger grip 30 as she or he holds the applicator like a pen. The exterior slide 16 is open ended and is substantially cylindrical in shape, except that it includes a cut-out portion 54 that accommodates the finger grip 30 on the cartridge housing 11 and the cartridge housing slot 28. The finger grips 30, 55 are preferably abraded or coated with an agent to prevent slippage.

The liquids applicator 10*b* preferably further includes a dispensing mechanism 49 for dispensing liquid from the liquids cartridge 13, as seen in FIGS. 6, 9, 10, and 13 and described hereinabove. The interior slide groove 36 includes a nick 39 in the interior slide groove 36, as can be seen in FIG. 7 and described hereinabove. FIGS. 6 and 7 are the same for the two applicators 10, 10*b*. The activation and unlocking of the applicator dispensing/locking mechanism 49 is also as described hereinabove.

As the applicator 10*b* is being used, the second, bent portion 51*b* of the exterior slide nib 51 moves up and down in the cartridge housing slot 28 with the interior slide 35. Since the first portion 51*a* of the exterior slide nib 51 is attached to the exterior slide 16, the exterior slide nib 51 moves up and down in the cartridge housing slot 28 as the exterior slide 16 moves up and down over the cartridge housing 11.

The second, bent portion 51*b* of the exterior slide nib 51 has approximately the same width as the cartridge projection 40. The cartridge housing slot 28 is only slightly wider than the cartridge projection 40 and the bent portion 51*b* of the exterior slide nib 51. The cartridge projection 40 lies against the cartridge stop 29, thus holding the cartridge 13 in place within the cartridge housing 11 and preventing it from wobbling. When the user pushes the exterior slide 16 down incrementally, ordinarily by means of a forefinger on the exterior slide finger grip 55, the exterior slide nib 51 moves down. Since a portion of the exterior slide nib 51 lies within the interior slide groove 36, the interior slide 35 is pushed down within the cartridge 13 at the same time. Pushing the interior slide 35 down within the cartridge 13 (see FIG. 2) causes the liquid within the cartridge to be expelled from the cartridge liquids aperture 45. The expelled liquid flows onto the brush bristles 23, and can be applied on the desired substrate.

Another locking mechanism 58 is provided by the end cap 17, which includes an end cap screw 56 near the opening 57 of the end cap (see FIGS. 9 and 13). The end cap screw 56 extends through one side of the end cap at the edge of the end cap 17 adjacent the end cap opening 57. The end of the end cap screw 56 extends into the interior of the end cap 17. When the end cap 17 is placed down over the cartridge housing opening 31 of the assembled applicator, the end of the end cap screw 56 is moved generally vertically into the top of the cartridge housing notch 27. The end cap 17 is then twisted in a generally horizontal direction to move the end cap screw 56 into the notch 27 on the cartridge housing 11. This temporarily locks the end cap 17 on the applicator 10*b* (see FIG. 9). Even when the applicator 10*b* is upended, the parts and liquid will not fall or seep out of the applicator. The end cap 17 can be unlocked by reversing direction, so the end cap screw 56 comes out of the cartridge housing notch 27, and then out of the cartridge housing slot 28.

The applicator of the present invention may be used in a variety of applications. The present applicator may have a foam tip or rigid fork, for example, instead of a brush, depending on the type of liquid to be applied and the particular substrate on which it will be applied. The applicator of the present invention may be used by a dentist, for example, to hold materials for applying restorations and veneers or for applying tooth whiteners. It may be used for dispensing toothpaste or fluoride formulas for application on teeth. The applicator of the present invention may be used in a research laboratory for precisely applying liquid chemical preparations or other liquids to a substrate. The present applicator may be used by a student or office workers for controlled application of white-out, glue, paint, or other liquids used in office work. The applicator of the present invention may be used to apply liquid bandages. In addition to being used to apply hair relaxant, the applicator of the present invention may be used to apply permanent or semi-permanent hair color at home or in a salon. The present applicator may be used in automobile body shops for controlled application of touch up paints to car bodies. It may be used in the kitchen for applying condiments, such as mustard.

From the foregoing it can be realized that the described device of the present invention may be easily and conveniently utilized as a liquids applicator. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 liquid applicator
11 cartridge housing
12 cartridge assembly
13 cartridge
14 cartridge chamber
15 applicator head portion
16 exterior slide
17 end cap
18 fingernail substrate
19 brush head holes
20 brush cap
21 brush
22 brush support opening
23 bristles
24 brush support
25 brush head threading
26 brush head channel
27 cartridge housing notch
28 cartridge housing slot
29 cartridge stop
30 cartridge housing finger grip
31 cartridge housing first opening
32 cartridge housing opening
33 cartridge housing threading
34 open end of brush cap
35 interior slide
36 interior slide groove
37 interior slide tip
38 interior slide seal
39 interior slide nick
40 cartridge projection
42 cartridge first opening
43 cartridge neck
44 cartridge threads
45 cartridge liquids aperture
46 cartridge ring
47 cartridge seal
48 first bristle end
49 dispensing mechanism
51 exterior slide nib
52 exterior slide first end
53 exterior slide second end
54 exterior slide cut-out
55 exterior slide finger grip
56 end cap screw
57 end cap opening
58 end cap locking mechanism
59 cap tail
60 cartridge housing bead
61 brush support bore
63 view window
64 gradations in window

What is claimed is:

1. An all-in-one applicator for dispensing and applying a liquid, the applicator comprising:

(a) an elongated, hollow cartridge housing;

(b) a cartridge assembly disposable within the cartridge housing, the cartridge assembly comprising at least one liquids cartridge and an interior slide, the liquids cartridge comprising an open upper end and an opposite, lower end of the liquids cartridge comprising a cartridge liquids aperture, at least a portion of the interior slide being slidable into the cartridge from the open upper end of the cartridge;

(c) an exterior slide that is slidable over the cartridge housing;

(d) an applicator head portion that is removably attachable to an open lower end of the cartridge housing; and (e) a liquid dispensing mechanism that causes liquid to be dispensed from the cartridge liquids aperture into the applicator head portion in response to movement of the exterior slide over the cartridge housing ; wherein the cartridge housing comprises a cartridge housing slot in an upper portion of the cartridge housing; and wherein the liquid dispensing mechanism comprises an exterior slide nib on the exterior slide, a first portion of the exterior slide nib being affixed to an upper end of the exterior slide, a second portion of the exterior slide nib projecting through the cartridge housing slot into an upper end portion of the interior slide, the exterior slide nib being movable along the cartridge housing slot; and wherein the cartridge comprises a cartridge projection adjacent an upper end thereof, the cartridge projection extending through the cartridge housing slot.

2. The applicator according to claim 1, wherein the applicator head portion is removable and comprises an applicator brush, the liquid being dispensed from the cartridge liquids aperture onto the applicator brush.

3. The applicator according to claim 2, wherein the applicator head portion comprises a brush support at an open upper end thereof, and a brush at a lower end of the applicator head portion, the brush support comprising a central brush support bore in communication with the cartridge liquids aperture.

4. The applicator according to claim 3, wherein the brush support comprises a brush head threading adjacent a brush support opening at the end of the brush support.

5. The applicator according to claim 3, wherein the brush support comprises a brush support bore in communication with the brush, a portion of the brush support bore comprising threads that correspond to cartridge threads on an end portion of the cartridge neck.

6. The applicator according to claim 2, wherein the liquids cartridge is single and removable, and a lower, second end of the interior slide is slidable into the open upper end of the liquids cartridge.

7. The applicator according to claim 6, wherein the applicator head portion further comprises a brush support attached to the brush, an upper end of the brush support being removably attachable to the open lower end of the cartridge housing.

8. The applicator according to claim 7, wherein the brush support comprises a plurality of brush head holes in a lower end of the brush support, and a plurality of interior brush head channels within the brush support, the channels opening to the brush head holes at one end and the cartridge liquids aperture at an opposite end of the channels.

9. The applicator according to claim 7, wherein the cartridge is substantially cylindrical, and comprises a hollow central chamber in the cartridge and a tapered neck at the second, lower end of the cartridge, a central bore in the cartridge neck extending from the cartridge chamber to the cartridge liquids aperture.

10. The applicator according to claim 9, wherein a lower end portion of the cartridge neck is threaded, and an end portion of a brush support bore in the brush support is correspondingly threaded.

11. The applicator according to claim 10, wherein the cartridge substantially fully accommodates the interior slide when the cartridge is relatively empty of the liquid.

12. The applicator according to claim 1, wherein the cartridge housing slot comprises a cartridge stop at a lower end of the cartridge housing slot, the cartridge projection being adjacent the cartridge stop when the cartridge is in the cartridge housing, the cartridge housing slot being open at a first, upper end of the cartridge housing slot to a cartridge housing opening at a first, upper end of the cartridge housing.

13. The applicator according to claim 1, wherein the cartridge housing further comprises a cartridge housing finger grip on an outer surface of the cartridge housing on one side of the cartridge housing slot.

14. The applicator according to claim 13, wherein the slidable exterior slide comprises an exterior slide finger grip on its outer surface on an opposite side of the cartridge housing slot.

15. An all-in-one applicator for dispensing and applying a liquid, the applicator comprising:

(a) an elongated, hollow cartridge housing;

(b) a cartridge assembly disposable within the cartridge housing, the cartridge assembly comprising at least one liquids cartridge and an interior slide, the liquids cartridge comprising an open upper end and an opposite, lower end of the liquids cartridge comprising a cartridge liquids aperture, at least a portion of the interior slide being slidable into the cartridge from the open upper end of the cartridge;

(c) an exterior slide that is slidable over the cartridge housing;

(d) an applicator head portion that is removably attachable to an open lower end of the cartridge housing, the applicator head portion being removable and comprising an applicator brush; and (e) a liquid dispensing mechanism that causes liquid to be dispensed in response to movement of the exterior slide over the cartridge housing; the liquid being dispensable through the cartridge liquids aperture onto the applicator brush; wherein the cartridge housing comprises a cartridge housing slot in an upper portion of the cartridge housing; wherein the liquid dispensing mechanism comprises an exterior slide nib on the exterior slide, a first portion of the exterior slide nib being affixed to an upper end of the exterior slide, and wherein a second portion of the exterior slide nib projects into an interior slide groove, the interior slide groove encircling an upper end portion of the interior slide, the exterior slide nib being movable along the cartridge housing slot.

16. The applicator according to claim 15, wherein the interior slide groove comprises a nick, the exterior slide nib being insertable into the interior slide groove nick when the exterior slide is over the cartridge housing.

17. An applicator for dispensing and applying a liquid, the applicator comprising:

(a) an elongated, hollow cartridge housing, the cartridge housing comprising a cartridge housing slot in an upper portion of the cartridge housing, and a cartridge housing finger grip on an outer surface of the cartridge housing on one side of the cartridge housing slot;

(b) a cartridge assembly disposable within the cartridge housing, the cartridge assembly comprising at least one liquids cartridge and an interior slide, the liquids cartridge comprising an open upper end and an opposite, lower end of the liquids cartridge comprising a cartridge liquids aperture, at least a portion of the interior slide being slidable into the cartridge from the open upper end of the cartridge;

(c) an exterior slide that is slidable over the cartridge housing;

(d) an applicator head portion that is removably attachable to an open lower end of the cartridge housing;

(e) a liquid dispensing mechanism that causes liquid to be dispensed from the cartridge liquids aperture into the applicator head portion in response to movement of the exterior slide over the cartridge housing; and (f) a locking mechanism comprising a removable end cap, the end cap comprising an end cap screw in one side of the end cap, an end portion of the end cap screw extending into a hollow interior of the end cap, the end portion of the end cap screw being insertable into the cartridge housing slot when the end cap covers the cartridge housing opening.

18. The applicator according to claim 17, wherein the cartridge housing slot also opens to a notch in the cartridge housing adjacent a first, upper end of the cartridge housing, the cartridge housing notch extending generally perpendicularly to the cartridge housing slot, an end portion of the end cap screw being movable into the cartridge housing notch when the end cap is twisted.

19. The applicator according to claim 17, further comprising a removable brush cap, an open end of the brush cap comprising threads that correspond to threads on a lower end of the cartridge housing, the brush cap also being securable over the end cap.

20. The applicator according to claim 19, wherein the brush cap further comprises an absorbent interior layer that has been soaked in a chemical that removes the liquid from the brush.

21. The applicator according to claim 17, wherein the end cap further comprises a cap tail at the end of the cap opposite an end cap opening.

22. The applicator according to claim 17, wherein the cartridge is transparent and the cartridge housing comprises a transparent view window in a side of the cartridge housing.

* * * * *